US009844288B2

(12) United States Patent
Fu et al.

(10) Patent No.: US 9,844,288 B2
(45) Date of Patent: Dec. 19, 2017

(54) CONNECTOR SYSTEM

(71) Applicant: POLYGROUP MACAU LIMITED (BVI), Road Town, Tortola (VG)

(72) Inventors: Yong Fu, Zhu Yang Town (CN); Chung-Wai (Paul) Cheng, Hong Kong (CN)

(73) Assignee: POLYGROUP MACAU LIMITED (BVI), Road Town, Tortola (VG)

( * ) Notice: Subject to any disclaimer, the term of this patent is extended or adjusted under 35 U.S.C. 154(b) by 293 days.

(21) Appl. No.: 14/547,406

(22) Filed: Nov. 19, 2014

(65) Prior Publication Data

US 2015/0072088 A1 Mar. 12, 2015

Related U.S. Application Data

(63) Continuation of application No. 12/982,015, filed on Dec. 30, 2010, now Pat. No. 8,916,242.

(60) Provisional application No. 61/291,481, filed on Dec. 31, 2009.

(51) Int. Cl.
*A47G 33/06* (2006.01)
*A41G 1/00* (2006.01)

(52) U.S. Cl.
CPC ..... *A47G 33/06* (2013.01); *A41G 1/007* (2013.01); *Y10T 29/49826* (2015.01); *Y10T 29/49947* (2015.01); *Y10T 403/7035* (2015.01)

(58) Field of Classification Search
None
See application file for complete search history.

(56) References Cited

U.S. PATENT DOCUMENTS

| | | | | |
|---|---|---|---|---|
| 1,656,148 | A | 1/1928 | Harris | |
| 2,112,281 | A | 3/1938 | Ferris | |
| 2,188,529 | A | 1/1940 | Corina | |
| 2,533,374 | A | 12/1950 | Hyland | |
| 2,932,811 | A | 4/1960 | Abraham et al. | |
| 3,118,617 | A | 1/1964 | Hellrich | |
| 3,521,216 | A | 7/1970 | Tolegian | |
| 3,663,924 | A | 5/1972 | Gerlat | |
| 3,715,708 | A | 2/1973 | Lloyd et al. | |
| 3,970,834 | A | 7/1976 | Smith | |
| 3,971,619 | A | 7/1976 | Rohrssen | |
| 3,985,924 | A | 10/1976 | Pritza | |
| 4,468,925 | A * | 9/1984 | Kersting | F01N 13/10 60/322 |
| 4,516,193 | A | 5/1985 | Murphy | |
| 4,753,600 | A | 6/1988 | Williams | |
| 4,772,215 | A | 9/1988 | Falk | |
| 4,775,922 | A | 10/1988 | Engel | |
| 4,921,369 | A * | 5/1990 | Chew, II | A47D 7/002 135/116 |
| 5,149,282 | A | 9/1992 | Donato et al. | |

(Continued)

FOREIGN PATENT DOCUMENTS

| | | | |
|---|---|---|---|
| CN | 2332290 | Y | 8/1999 |
| DE | 843632 | C | 7/1952 |
| WO | 9626661 | A | 9/1996 |

*Primary Examiner* — Adam Krupicka
(74) *Attorney, Agent, or Firm* — Troutman Sanders LLP; Ryan A. Schneider; Christopher C. Close, Jr.

(57) ABSTRACT

A connector system facilitates the connection of a first tree trunk to a second tree trunk of an artificial tree system. The connector system can prohibit rotation of the first tree trunk relative to the second tree trunk.

13 Claims, 6 Drawing Sheets

(56) References Cited

U.S. PATENT DOCUMENTS

| | | | |
|---|---|---|---|
| 5,517,390 | A | 5/1996 | Zins |
| 5,639,157 | A | 6/1997 | Yeh |
| 5,695,279 | A | 12/1997 | Sonnleitner et al. |
| 5,776,559 | A | 7/1998 | Woolford |
| 5,776,599 | A | 7/1998 | Haluska et al. |
| 6,458,435 | B1 | 10/2002 | Lai |
| 6,854,916 | B2 | 2/2005 | Hsieh |
| 6,869,316 | B2 | 3/2005 | Hinkle et al. |
| 7,029,145 | B2 | 4/2006 | Frederick |
| 7,052,156 | B2 | 5/2006 | Primeau |
| 7,108,514 | B2 | 9/2006 | Chen et al. |
| 7,132,139 | B2 | 11/2006 | Yang |
| 7,144,610 | B1 | 12/2006 | Estes et al. |
| 7,318,744 | B2 | 1/2008 | Kuo |
| 7,585,187 | B2 | 9/2009 | Daily et al. |
| 7,652,210 | B2 | 1/2010 | White |
| 8,053,042 | B1 | 11/2011 | Loomis |
| 8,132,649 | B2 | 3/2012 | Rogers |
| 8,298,633 | B1 | 10/2012 | Chen |
| 8,454,186 | B2 | 6/2013 | Chen |
| 8,454,187 | B2 | 6/2013 | Chen |
| 8,469,734 | B2 | 6/2013 | Chen |
| 8,527,508 | B2 | 9/2013 | Takahashi et al. |
| 2007/0230174 | A1 | 10/2007 | Hicks et al. |
| 2010/0072747 | A1 | 3/2010 | Krize |
| 2011/0256750 | A1 | 10/2011 | Chen |
| 2013/0108808 | A1 | 5/2013 | Leung et al. |
| 2013/0120971 | A1 | 5/2013 | Chen |
| 2013/0309908 | A1 | 11/2013 | Sandoval et al. |

* cited by examiner

CONNECTOR SYSTEM

CROSS-REFERENCE TO RELATED APPLICATION

This Application is a Continuation of U.S. patent application Ser. No. 12/982,015, filed 30 Dec. 2010, which claims the benefit of U.S. Provisional Patent Application Ser. No. 61/291,481, filed 31 Dec. 2009, the entire contents of both of which are incorporated herein by reference as if fully set forth below.

FIELD OF THE INVENTION

The presently disclosed subject matter relates generally to artificial tree connectors.

BACKGROUND

As part of the celebration of the Christmas season, traditionally people bring a pine or evergreen tree into their home to decorate it with ornaments, lights, garland, tinsel, and the like. More traditionally, people obtain a cut, natural pine tree and bring it into the home for decorating and displaying over the Christmas season. Natural trees, however, can be quite expensive and are recognized by some as a waste of environmental resources. In addition, trees can be messy, leaving both sap and needles behind after removal, and requiring water to prevent drying out and becoming a fire hazard. Each time a natural tree is obtained it must be decorated, and at the termination of the Christmas season the decorations must be removed. Because the needles have dried and may be quite sharp by this time, removal of the decorations can prove to be a painful process. Also, oftentimes the natural tree is disposed in landfills, further polluting these overflowing settings.

To overcome the disadvantages of a natural tree yet still celebrate with a Christmas tree, a great variety of artificial trees are available. For the most part, these artificial trees must be assembled for use and disassembled after use. Artificial trees have the advantage of being usable over a period of years and thereby eliminate the annual expense of purchasing live trees for the short holiday season. Further, they help reduce the chopping down of trees for a temporary decoration, and the subsequent disposal, typically in a landfill, of same.

Generally, most artificial Christmas trees comprise a multiplicity of separate branches each formed of a plurality of plastic needles held together by twisting a pair of wires about them. In other instances, the branches are formed by twisting a pair of wires about an elongated sheet of plastic material having a large multiplicity of transverse slits. In still other artificial Christmas trees, the branches are formed by injection molding of plastic.

Irrespective of the form of branch, the most common form of artificial Christmas tree comprises a plurality of trunks connectable to one another. For example, the first and second trunks each comprise an elongate body. A first end of the body includes a receiving portion (e.g., a female end) and a second end of the body includes an extending portion (e.g., a male end). Typically, the body is a cylinder. Near the second end the body tapers slightly to reduce the diameter of the body. In other words, the diameter of the first end, i.e., the receiving portion, is larger than the diameter of the second end, i.e., the extending portion. To connect the trunks, the first end of a first trunk receives the second end of a second trunk. For example, the tapered end of the first trunk is inserted into the non-tapered end of the second trunk.

SUMMARY

Briefly described, embodiments of the presently disclosed subject matter relate to a connector system for connecting a first tree trunk section to a second tree trunk section. The connector system can prohibit rotation of the first tree trunk section relative to the second tree trunk section.

BRIEF DESCRIPTION OF THE DRAWINGS

The accompanying drawings, which are incorporated in and constitute a part of this specification, illustrate multiple embodiments of the presently disclosed subject matter and, together with the description, serve to explain the principles of the presently disclosed subject matter; and, furthermore, are not intended in any manner to limit the scope of the presently disclosed subject matter.

Figure 1:
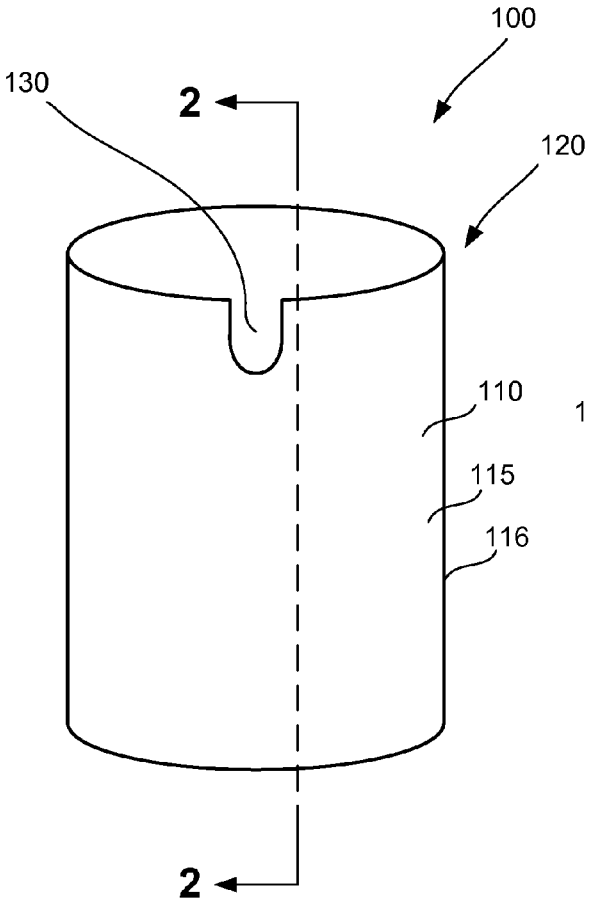
FIG. 1 is a side, perspective view of a sleeve adapted to provide a connection between a first body and second body, in accordance with an exemplary embodiment of the presently disclosed subject matter.

Any headings provided herein are for convenience only and do not necessarily affect the scope or meaning of the claimed presently disclosed subject matter

DETAILED DESCRIPTION

The various embodiments of the presently disclosed subject matter are described with specificity to meet statutory requirements. However, the description itself is not intended to limit the scope of this patent. Rather, it has been contemplated that the claimed subject matter might also be embodied in other ways, to include different steps or elements similar to the ones described in this document, in conjunction with other present or future technologies.

It should also be noted that, as used in the specification and the appended claims, the singular forms "a," "an" and "the" include plural references unless the context clearly dictates otherwise. References to a composition containing "a" constituent is intended to include other constituents in addition to the one named. Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges and/or sizes may be expressed herein as from "about" or "approximately" one particular value and/or to "about" or "approximately" another particular value. When such a range or size is expressed, other exemplary embodiments include from the one particular value and/or to the other particular value. Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the invention are intended to be illustrative and not restrictive. Many suitable components that would perform the same or similar functions as the components described herein are intended to be embraced within the scope of the invention. Such other components not described herein can include, but are not limited to, for example, similar components that are developed after development of the presently disclosed subject matter.

To facilitate an understanding of the principles and features of the invention, various illustrative embodiments are explained below. In particular, the presently disclosed subject matter is described in the context of being a connector system for assembling an artificial tree. Embodiments of the presently disclosed subject matter, however, are not limited to use in artificial tree. Rather, embodiments of the invention can be used for assembling other objects.

Referring now to the figures, wherein like reference numerals represent like parts throughout the views, the connector system will be described in detail.

Figure 2:
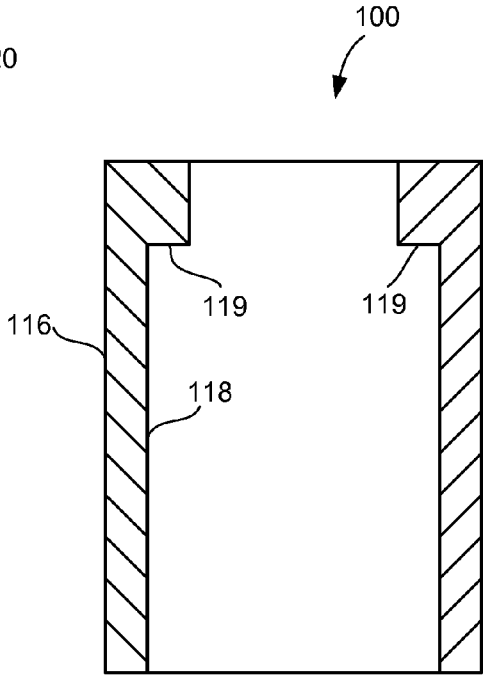
FIG. 2 is a cross-sectional view of the sleeve of FIG. 1 across line 2-2 of FIG. 1, in accordance with an exemplary embodiment of the presently disclosed subject matter.

FIG. 1 illustrates a side, perspective view of a connector system 100, and FIG. 2 illustrates a cross sectional view of the connector system 100. The connector system 100 facilitates the connection between two elongate members. The connector system 100 can be used for protecting ends of elongate members, for example, in an artificial tree system.

Figure 3:
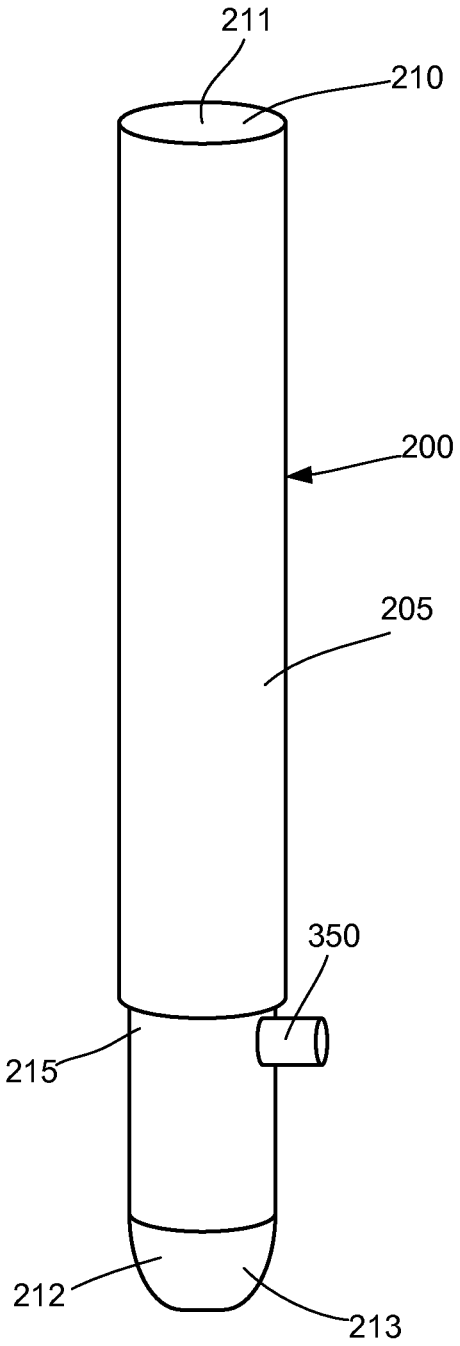
FIG. 3 is a perspective, side view of a first body, in accordance with an exemplary embodiment of the presently disclosed subject matter.

Typically, a conventional artificial tree includes a plurality of tree trunks that are connectable to one another. FIG. 3 illustrates a body, or tree trunk section 200, without branches (such branches would extend outwardly from the trunk 200). Each tree trunk section 200 includes an elongate body 205 with a first end 210 and a second end 212. Often times, the body 205 is made of metal, e.g., steel poles. In some embodiments, the elongate body 205 has a cylindrical shape—though other shapes can implemented—because the cylindrical shape is most similar to a natural tree trunk shape. Moving from the first end 210 to the second 212, the body is tapered near the second end 212 at a tapered region 215. As a result of this tapering, the second end 212 has a smaller perimeter, or diameter, than the diameter of first end 210. In some embodiments, both ends 210 and 212 are open, such that the elongate body 205 is a fully opened annular member. In some other embodiments, at least one end 210 or 212 is open, while the other is plugged.

In some embodiments, the first end 210 of the body 205 includes a receiving portion 211, e.g., a female end. The second end 212 of the body 205 includes an extending portion 213, e.g., a male end.

To conventionally assemble an artificial tree system, the first end 210 of a first body receives the second end 212 of a second body. Depending on the height of the tree and the length of the bodies used, the number of connections necessary to complete the assembly of the tree will vary. Unfortunately, in many circumstances, for example and not limited, when the artificial tree system is being shipped and/or stored, the ends of the bodies are damaged. For instance, the first end 210 of the body, e.g., the receiving portion 211, which is adapted to receive a second end of another body, is deformed or bent and thus cannot effectively receive the second end 212. As a result, the artificial tree system cannot be assembled, potentially ruining a festive event.

Among other things, embodiments of the present invention can reduce, if not prevent, the damage to the ends of the body of the trunks. Among other things, embodiments of the present invention improve the connection between the trunks.

As shown in FIGS. 1-2, the connector system 100 comprises a sleeve 110. The sleeve 110 comprises a cylindrical shaped body 115. The outer 116 of the body 115 preferably has a uniform cylindrical shape. As illustrated in FIG. 2, the interior 118 of the body 115 can have different sizes at its top and at its bottom. The interior 118 includes a notch or shoulder 119. The shoulder 119 is in proximity to the top end 120 of the sleeve 110.

For example and not limitation, in an exemplary embodiment, the sleeve 110 can be approximately 3 5/16 inches long, wherein the shoulder 119 is approximately half an inch (½") from the top and approximately 2 13/16 inches from the bottom. The shoulder 119 can be positioned at different lengths from the each end, depending on the length of the sleeve 110, the length of the particular bodies 200/300, and/or the diameter of the sleeve 110.

The depth of the shoulder 119 can provide a flush transition between the two body ends that it receives. For example, the inner diameter of the first end of the sleeve, which has a smaller diameter than the second end of the sleeve, is approximately equal to the inner diameter of the second end of the sleeve when the receiving end of a body is inserted into the second end of the sleeve. In other words, the inner diameter of the first end of the sleeve is approximately equal to the receiving end of the body which the sleeve can protect.

Figure 4:
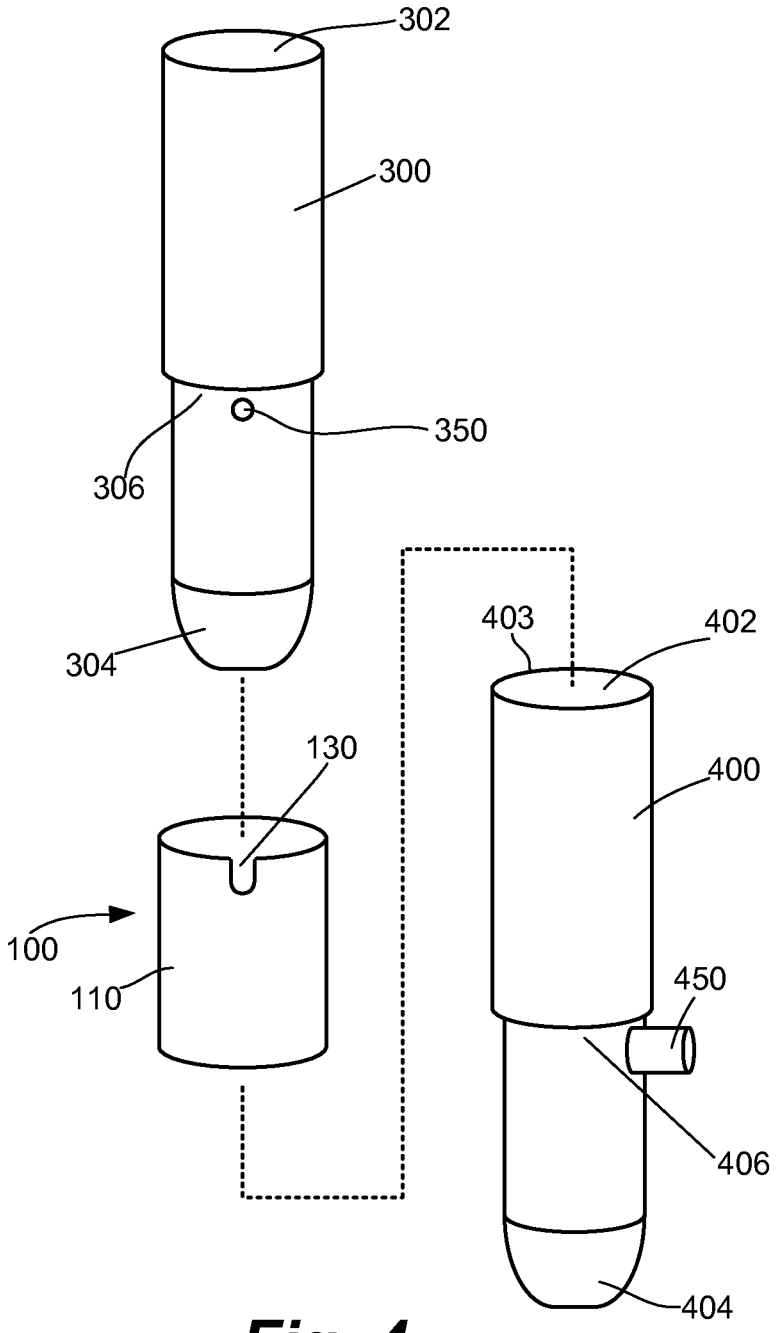
FIG. 4 is a perspective, exploded view of a first body insertable into a first end of the sleeve of FIG. 1 and a second end of a second body insertable into a second end of the sleeve, in accordance with an exemplary embodiment.
Figure 5:
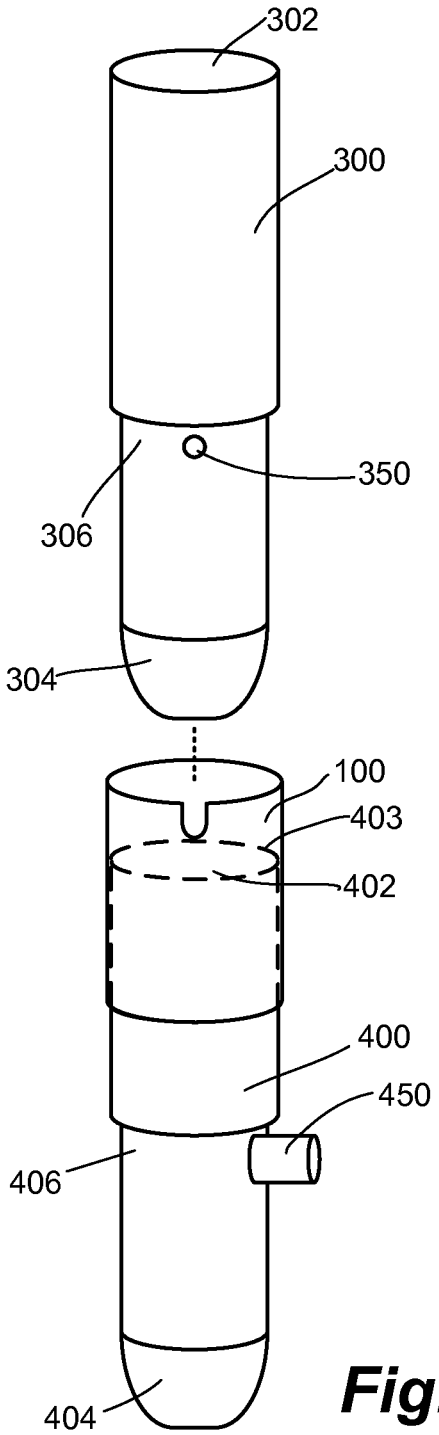
FIG. 5 is a perspective partial exploded view of the sleeve providing connection between a first body and a second body, in accordance with an exemplary embodiment of the presently disclosed subject matter.

The sleeve 110 further includes a cutout 130. In an exemplary embodiment, the cutout 130 can have a U-shape, as shown in FIGS. 1 and 4-5. The cutout 130 can extend into the body of the sleeve from an end, e.g., the top end 120 as illustrated.

FIG. 4 illustrates an exploded view of the assembly of two bodies 300, 400 forming at least a portion of the tree trunk. As illustrated, a first tree trunk 300 includes a first receiving end 302 and a second extending end 304. The first tree trunk 300 also includes a tapered region 306, providing the second extending end 304 with a smaller diameter than the first receiving end 302. Near the second extending end 304 is an outwardly extending member 350, which extends normal to the cylindrically-shaped trunk 300. A second tree trunk 400 includes a first receiving end 402 and a second extending end 404. The second tree trunk 400 also includes a tapered region 406, providing the second extending end 404 with a smaller diameter than the first receiving end 402. Near the first extending end 404 is an outwardly extending member 450, which extends normal to the cylindrically-shaped trunk 400. Each tree trunk 300 and 400 includes the outwardly extending member 350/450 that can engage the cutout 130 of the sleeve. The sleeve 110 provides the connection between the two trunks, and further protects the ends of the trunks from damage. The sleeve 110 includes the cutout 130.

The bottom of the sleeve 110 can be placed over the first receiving end 402 of the second tree trunk 400. As shown in FIGS. 4-5, the edge 403 of the first receiving end 402 will be inserted into the bottom of the sleeve 110 until it reaches the shoulder 119. This protects the first receiving end 402 of the second trunk 400. During shipment and/or storage, the sleeve 100 can be secured about the first end of the body for protecting that end, which may be the receiving end of the body.

In addition, the outwardly extending member 350 of the first tree trunk 300 can be lined up with the cutout 130 of the sleeve 110. Once lined up, the second extending end 304 of the first trunk 300 can be inserted into the top of the sleeve 110. The outwardly extending member 350 of the first trunk 300 can be received by the cutout 130. This prohibits rotation of the first trunk 300 relative to the second trunk 400.

In some embodiments, the sleeve 110 can be a plastic insert insertable into the tapered end of the pole 200, 300 or 400 (e.g., tree trunk) to resist deforming. Also, an outwardly extending member or protruding device 350/450 (e.g., a steel bolt) can be inserted normal to the pole. The end of the protruding device 350/450 extends outwardly from the pole.

In some embodiments, the plastic sleeve can also be placed over the female end of another tree pole, and can be held in place by securement devices such as steel nails and/or rivets, which can be placed through opposing sides of both the tree pole and the sleeve. This can protect the female end of the pole from deformation. The sleeve includes the cutout or notch to permit the outwardly extending member, or protruding device, from inserting into the sleeve to prevent the tree sections to rotate independently. In essence, the combination of the outwardly extending member of the tree trunk and the cutout of the sleeve provide a rotation locking characteristic as well as the ability to align pole 300 with pole 400.

In some embodiments, the sleeve is adapted to be placed on the trunk in a single direction. That is, the sleeve can be designed so that the female section will only fit in one direction and the new female end will be of the same diameter as the original pole. This can be accomplished by molding the sleeve so that inside, it has two thicknesses, via the shoulder. The wider end permits the hollow section to fit therein. The other end is narrower, not only stopping the hollow end from being inserted further than designed, but allowing the tapered end to fit into the sleeve perfectly, as it would if no sleeve existed. In some embodiments, this minimizes manufacturing costs because conventional tree poles need no change in design. In addition, the conventional poles can be used independently of the sleeve. The sleeve can improve the trunks, the means of shipping and storage, and extend their lifespan.

Figure 6:
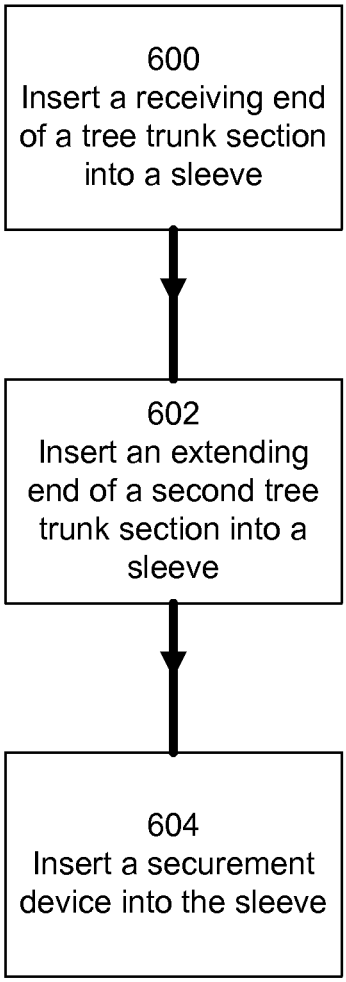
FIG. 6 is an exemplary method for assembling a tree trunk according to various aspects of the presently disclosed subject matter.

FIG. 6 is an exemplary method for using a securement device. A receiving end of a tree trunk section is inserted 600 into a sleeve. Thereafter, an extending end of a second tree trunk section is inserted 602 into the sleeve. This process is repeated with other tree trunk sections (not illustrated) until the tree trunk is fully or partially assembled. During the process of assembling the tree trunk, it may be desirable to secure the tree trunk sections to each other. A securement device may be used. A securement device, such as a nail, pin or screw, may be inserted 604 into one or more apertures of the sleeve to secure the sleeve to that particular tree trunk section. Another securement device, again e.g. a nail, pin or screw, may be inserted into the other tree trunk section for the same sleeve. This may help to secure the tree trunk sections together, forming a more secure connection.

Figure 7:
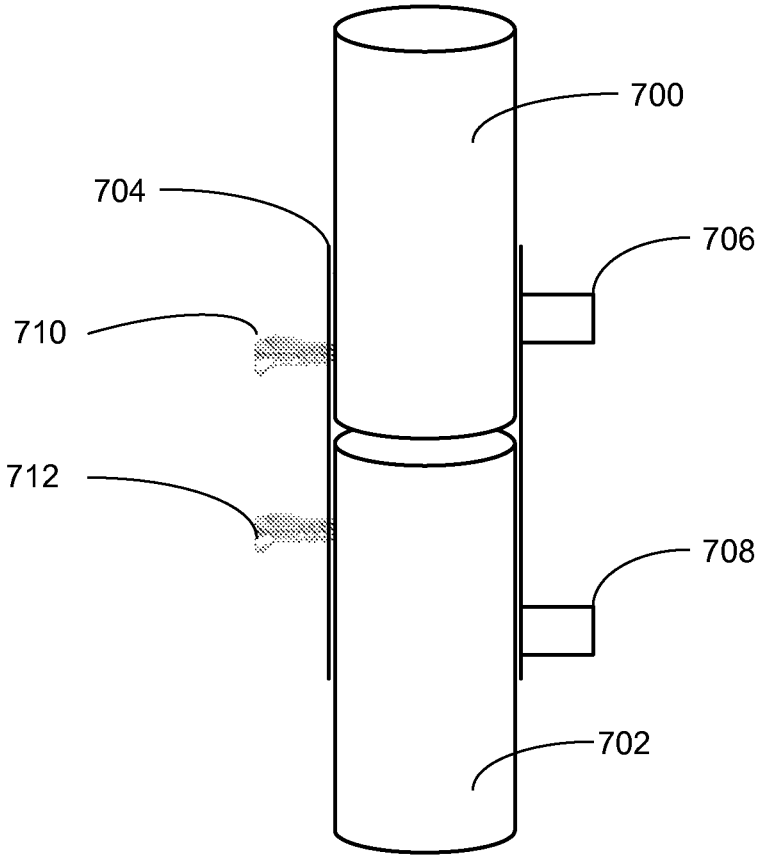
FIG. 7 is an exemplary assembled portion of a tree trunk using two securement devices according to various aspects of the presently disclosed subject matter.

FIG. 7 is an illustration of a portion of a tree trunk assembled using one or more securement devices. Tree trunk section 700 and tree trunk section 702 are inserted into generally hollow sleeve 704. In this example, to align the tree trunk sections together, sleeve 704 has two cutouts (not shown) through which extending member 706 of tree trunk section 700 and extending member 708 of tree trunk section 702 are inserted. In this example, the cutouts are configured so that extending members 706 and 708 may be inserted in their respective cutouts as tree trunk sections 700 and 702 are inserted into sleeve 704. It may be desirable or necessary to provide for a more secure attachment than what may be provided by sleeve 704 alone, so a securement device may be used. In this example, screw 710 and screw 712 are used to secure tree trunk sections 700 and 702 to sleeve 704, and consequently, to each other. Screw 710 is threaded or inserted into an aperture (not shown) of sleeve 704 and screw 712 is threaded or inserted into a second aperture (not shown) of sleeve 704. Preferably, screws 710 and 712 are thereafter threaded into their respective tree trunk sections. As disclosed above, securement devices 710 and/or 712 may also be items such as nails, rivets, pins, etc. The presently disclosed subject matter is not limited to any particle type of securement device.

While the present disclosure has been described in connection with a plurality of exemplary aspects, as illustrated in the various figures and discussed above, it is understood that other similar aspects can be used or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

What is claimed is:

1. An artificial tree comprising:

a first tree trunk section comprising a tapered end and the tapered end having a sleeve disposed thereon, the sleeve comprising a notch;

a second tree trunk section comprising a hollow end, the hollow end of the second tree trunk section configured to at least partially receive the tapered end of the first tree trunk section; and an outwardly extending member extending normal to the second tree trunk section, the outwardly extending member operable to engage the notch to provide a rotation locking characteristic between the first tree trunk section and the second tree trunk section.

2. The artificial tree of claim 1, wherein the outwardly extending member is a first outwardly extending member, the artificial tree of claim 1 further comprising a second outwardly extending member extending normal to the first tree trunk section.

3. The artificial tree of claim 2, wherein the notch is a first notch, the second tree trunk section further comprising a second notch, and wherein the second outwardly extending member is received by the second notch to provide the rotation locking characteristic between the first tree trunk section and the second tree trunk section.

4. The artificial tree of claim 1, wherein the sleeve insert abut at least a portion of an external wall of the first tree trunk section, the sleeve configured to resist deformation of the first tree trunk section.

5. The artificial tree of claim 1, wherein the notch is U-shaped.

6. The artificial tree of claim 1, wherein the notch extends from an end of the sleeve.

7. An artificial tree comprising:

a first tree trunk section;

an outwardly extending member attached to the first tree trunk section;

a second tree trunk section; and an insert completely disposed within a hollow end of the second tree trunk section, the insert comprising a notch configured to receive the outwardly extending member;

wherein the second tree trunk section is configured to at least partially receive the first tree trunk section, such that, upon insertion of the outwardly extending member into the notch, a rotation locking characteristic is provided between the first tree trunk section and the second tree trunk section.

8. The artificial tree of claim 7, wherein the insert is secured in place within the second tree trunk section.

9. The artificial tree of claim 7, the insert comprising plastic.

10. The artificial tree of claim 9, the first and second tree trunk sections comprising metal.

11. The artificial tree of claim 7, wherein an end of the outwardly extending member extends outwardly from the first tree trunk section.

12. The artificial tree of claim 7, wherein the outwardly extending member extends normal to the first tree trunk section.

13. A method of assembling an artificial tree, the method comprising:

inserting a tapered end of a first tree trunk section into a hollow end of a second tree trunk section, the first tree trunk section comprising an outwardly extending member and the second tree trunk comprising a notched insert disposed completely therein; and inserting the outwardly extending member into the notch of the insert to provide a rotation locking characteristic between the first tree trunk section and the second tree trunk section.

* * * * *